US007237501B2

(12) United States Patent
Stallings et al.

(10) Patent No.: US 7,237,501 B2
(45) Date of Patent: Jul. 3, 2007

(54) MEANS AND APPARATUS FOR ONE PERSON TO LOAD AND UNLOAD A MARINE VESSEL FROM A TRAILER WITHOUT ASSISTANCE FROM OTHER INDIVIDUALS

(76) Inventors: James Stallings, 5432 FM 415, Timpson, TX (US) 75975; Richard Burnes, 1107 Easton La., Allen, TX (US) 75002; Carl Fiorletta, 4600 Versailles La., Plano, TX (US) 75093

( * ) Notice: Subject to any disclaimer, the term of this patent is extended or adjusted under 35 U.S.C. 154(b) by 45 days.

(21) Appl. No.: 11/284,015

(22) Filed: Nov. 22, 2005

(65) Prior Publication Data

US 2007/0113769 A1 May 24, 2007

(51) Int. Cl.
*B63H 25/04* (2006.01)

(52) U.S. Cl. ..... 114/144 R; 440/84

(58) Field of Classification Search ..... 114/144 R; 440/84

See application file for complete search history.

(56) References Cited

U.S. PATENT DOCUMENTS 4,363,590 A * 12/1982 Crate ..... 414/518
4,826,197 A * 5/1989 Heinzen ..... 280/414.1
6,428,371 B1 * 8/2002 Michel et al. ..... 440/38
6,511,354 B1 * 1/2003 Gonring et al. ..... 440/87
6,799,528 B1 * 10/2004 Bekker ..... 114/151
6,848,382 B1 * 2/2005 Bekker ..... 114/144 B

* cited by examiner

*Primary Examiner*—Stephen Avila

(57) ABSTRACT

An electronic control system is provided to permit one-person loading and unloading of a vessel from a trailer. The control moves the vessel using bow, stern and fore/aft thrusters that are supplied by the boat manufacturer. Operator inputs to the system controller of the instant invention consist of one or more multi-axis joysticks and a multi-axis foot pedal that are mounted onboard the vessel and a hand-held remote control that permits owner control of the vessel while standing on shore. For one-person unloading and loading of the vessel from and to a trailer, the owner may, using the remote control, drive the vessel off of the trailer to a remote location in the water, park and have the vessel maintain its position with respect to GPS satellites, and call for the vessel to return to the launch point using location data that was previously recorded by the system control.

3 Claims, 2 Drawing Sheets

MEANS AND APPARATUS FOR ONE PERSON TO LOAD AND UNLOAD A MARINE VESSEL FROM A TRAILER WITHOUT ASSISTANCE FROM OTHER INDIVIDUALS

BACKGROUND OF INVENTION

Bow and stern thruster systems are typically used on large vessels for docking and maneuvering in harbors at low speed. These large vessels are commercial fishing boats, cruise and ocean-going cargo ships. As these multi-axis thruster systems are applied to smaller vessels, such as bass boats, medium size fishing boats, ski boats and small cruisers, a comprehensive control system is required for onboard control of the thruster system as well as remote control of the thruster system and boat for one-person loading and unloading of these smaller boats on and off of trailers. The present invention is a control system that provides this onboard as well as remote control of the thruster system for this purpose.

BRIEF SUMMARY OF THE INVENTION

The instant invention is a control system used to manage multi-axis thrusters on a marine vessel. Multi-axis thrusters typically consist of a bow thruster, a stern thruster and a fore/aft thruster. The bow thruster moves the bow of the vessel to the left or right, the stern thruster moves the stern or rear of the boat to the left or right, while the aft thruster is able to move the boat in a forward and rearward direction.

While bow and stern thrusters are commonly found on commercial fishing boats and large, ocean-going cruise ships, they offer many advantages when used on bass boats, small fishing boats and sport cruisers. While thrusters are used on large vessels for docking and maneuvering in a harbor, the instant invention provides this same capability plus the means and apparatus for controlling the thrusters from a location that is remote from the boat. The use of this remote control of the thrusters to facilitate one-person loading and unloading of a vessel will be taught.

As described in Para [004], a thruster system consists of a bow thruster, to move the bow in a left or right direction, a stern thruster to move the stern or rear of the boat in a left or right direction, relative to the centerline of the boat, and a third thruster to move the boat in a forward and rearward direction, measured on an axis that is parallel to the long axis or centerline of the boat. Onboard and remote control of these thrusters is the subject of this patent application.

This thruster control system consists of a central processing unit (CPU) with software to coordinate and direct power to specific thrusters to achieve the anticipated motion of the vessel. The operator input to the control consists of onboard control devices and a remote control device. The onboard control inputs for the thruster control consists of a primary and a secondary control. The primary onboard control input is a multi-axis joystick. This joystick input may be located at single or multiple locations in the boat. Control locations for these joysticks would typically be the main control or wheelhouse for the vessel, as well as the elevated control and observation area commonly referred to as the bridge on larger cabin cruisers and fishing vessels.

The secondary control input is a foot control that directs or calls for a fore/aft and side-to-side motion for the vessel. On fishing boats, a seated or standing fisherman could use this foot control to use the thruster system as a trolling motor for low-speed, quiet operation of the vessel. The third control input is a keyfob or hand-held remote control module for operation of the thruster system while standing on shore. This remote control capability would primarily be used in boat loading and unloading operations to move the boat to and from its trailer, using the thruster system.

DETAILED DESCRIPTION OF THE INVENTION

The instant invention provides a convenient method for one person to unload the vessel from its trailer, maneuver the vessel at low speeds for docking, fishing, etc, and reload the boat on the trailer, without assistance from a second individual.

Figure 2:
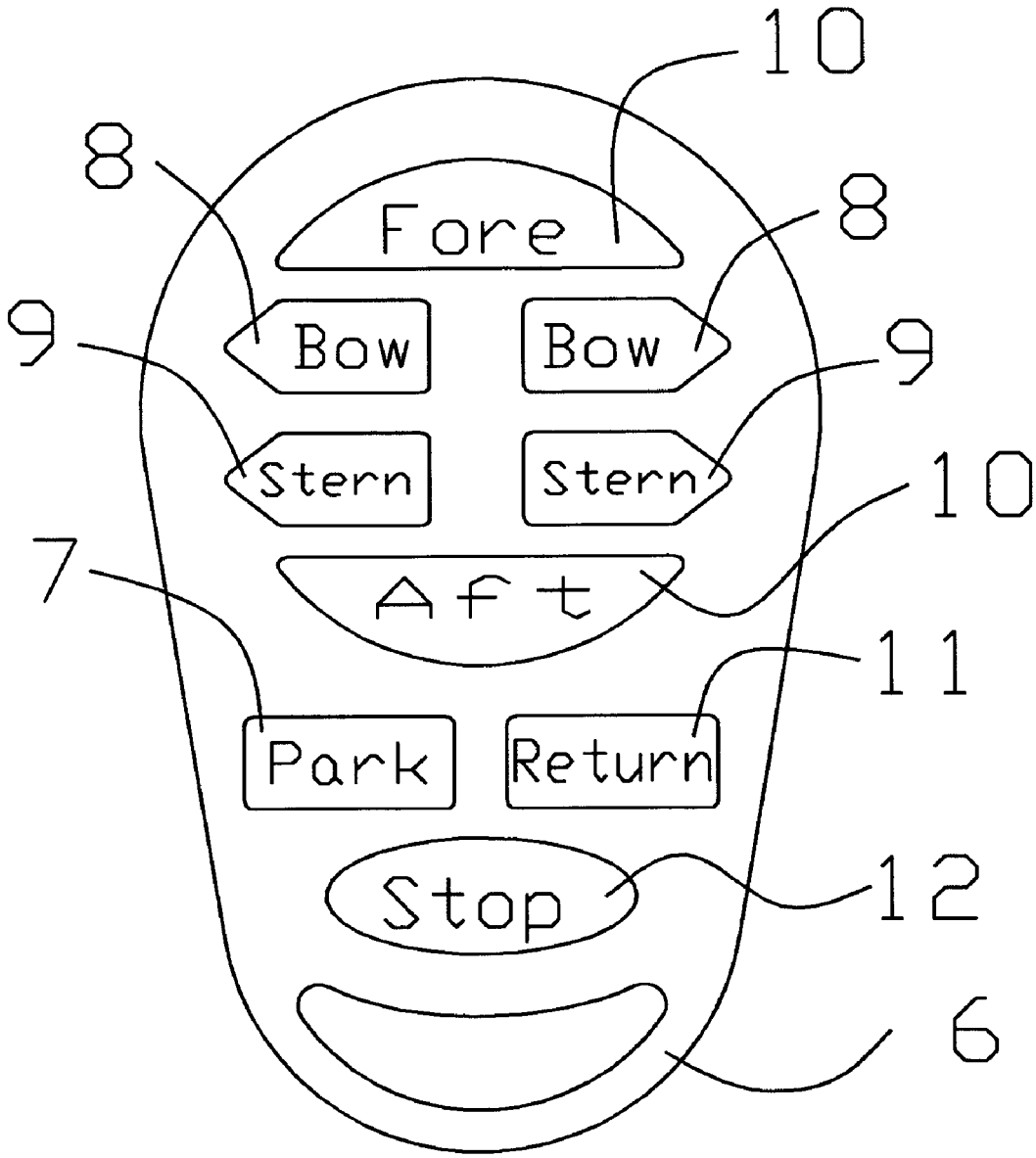
FIG. 2 is an example of the hand held control used to remotely control the vehicle using the instant invention. Provided in this hand-held device is the means to move the BOW left and right using control buttons 8, the ability to move the STERN left and right, using control buttons 9, the ability to move the vessel fore and aft, using the buttons 10, a single button 7 to PARK the vessel in a location that is distant from the owner, a button 11 to command the vessel to automatically RETURN to shore and finally, a button 12 to STOP all motion from the thruster propulsion system.

When preparing a vessel for use, the first operation is to launch the boat by floating the boat off of the trailer. This is performed by backing the boat and trailer into the water to a water depth that is sufficient to lift the boat off of the trailer. At this point the boat owner uses the hand-held remote control 6, FIG. 2, to back the boat off of the trailer, using the fore/aft thrusters in the boat. The thrusters are the boat's propulsion system that is secondary to the main drive system, which may be either inboard or outboard engines. With the boat or vessel now separated from the trailer, the owner uses the remote control 6 to drive the boat to a location that is safely removed or distant from the shoreline. This is particularly important if the shoreline is rocky, which would damage the boat and drive system if the boat is blown on to the rocks by wind or water currents while the owner is moving the tow vehicle and trailer to a parking area that is distant from the loading ramp. When the boat reaches a safe location, distant from shore, the owner presses the PARK button 7 on the remote control 6.

Figure 1:
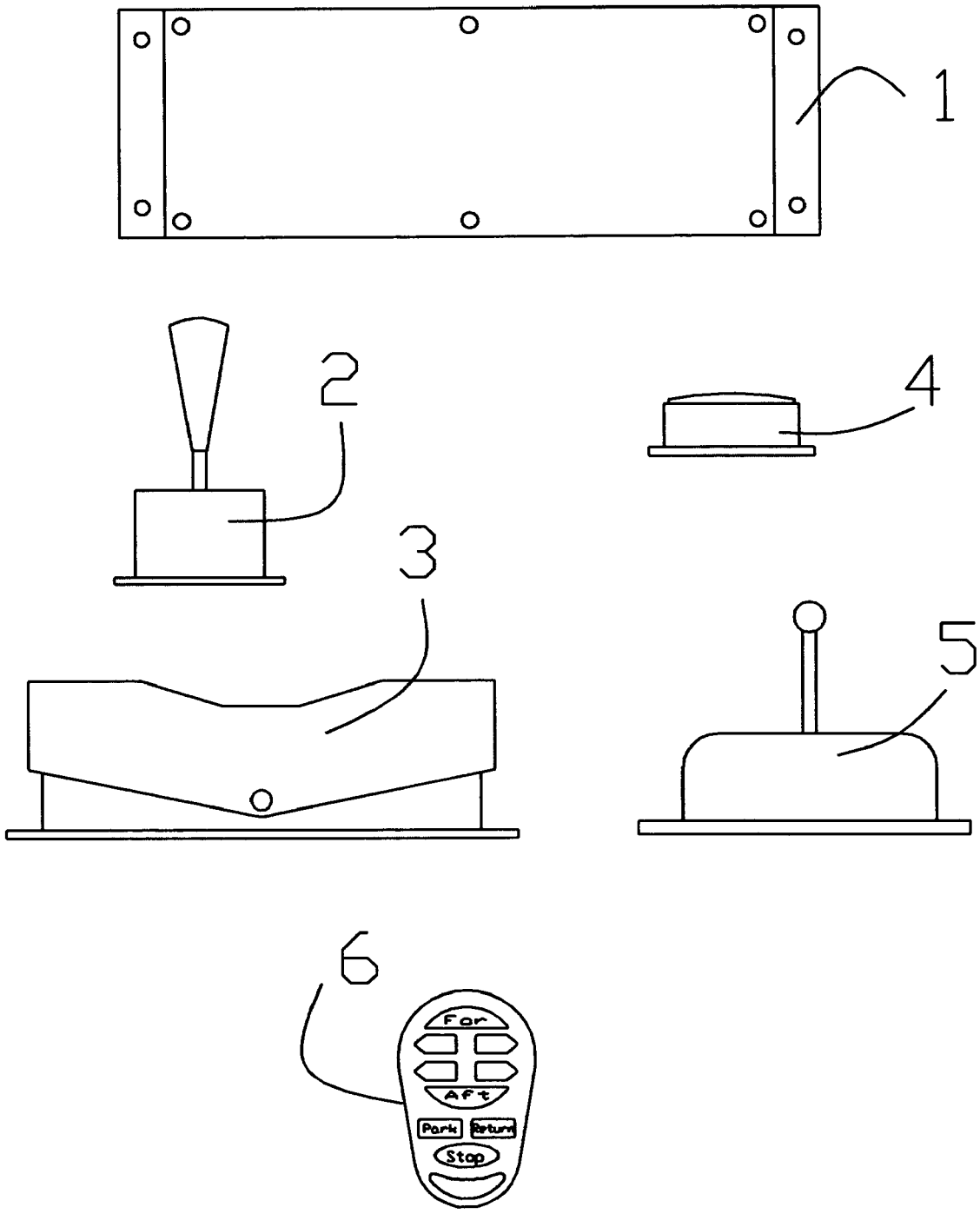
FIG. 1 shows the main components of the instant invention. These include the main system controller and CPU 1, one or more joystick stick controllers 2, a multi-axis foot pedal 3 for left/right and fore/aft control of the boat, a GPS transponder 4 to record the physical location of the boat with respect to multiple, orbiting GPS satellites, a transponder 5 to transmit a directional radio frequency beam to the boat when the boat is 'parked' offshore and distant from the trailer, and the hand-held key fob or remote control 6 for remote operation of the boats thruster system when the owner is not onboard the vessel.

At this point, the CPU 1 FIG. 1, records the GPS location of the vessel in its parked location using the GPS receiver 4 that is mounted on the vessel in clear view of the orbiting GPS satellites. On the 'Park' command, button 7, FIG. 2, the CPU 1 also records the compass heading from the vessel to the trailer, using a directional radio transmission from the transponder 5, FIG. 1, to the vessel. This compass heading recorded by the CPU marks the location of the boat loading ramp and the trailer, which will be useful when it is time for the vessel to return to shore to pick up its owner. While the boat owner is parking the trailer, the CPU of the instant invention uses the onboard thrusters to hold the boat on the previously recorded GPS position.

While the vessel was 'Parked' and holding a GPS location, the CPU1 continuously records the changing compass heading between the boat and the 'home' location on shore. When the boat owner returns to the boat ramp after parking the trailer, he presses the RETURN button 11 on the remote control 6. On the RETURN signal from the remote control 6, the CPU of the instant invention returns the boat to the home location using the onboard thrusters for propulsion. As the boat returns to shore, the owner may STOP the boat at any time using the Stop button 12 on the remote control 6. After the STOP command, the owner my take over control of the boat using the control buttons on the remote control. These consist of Bow left/right 8, stern left/right 9 and For/Aft control buttons 10.

While onboard the vessel, the owner may choose to use the thrusters instead of the vessel's main propulsion system for low speed maneuvering of the vessel for fishing and docking operations. For this purpose, the owner will use the multi-axis joystick 2, FIG. 1 for total control of the vessel. For hands-free operation of the boat, using the thrusters for propulsion, the owner will use the foot pedal 3, FIG. 1 which gives him the same overall control capability as the joystick 2.

When returning the boat to shore, for reloading on to the trailer, the procedures are very similar to the unloading operation. After returning to shore, the owner will step on to shore or to a dock and use the remote control 6 to drive the boat to a safe location that is distant from the shore and park the boat by pressing the Park button 7 on the remote control 6. With the boat safely parked, the owner retrieves the tow vehicle and trailer from its parked location, backs the trailer into the water, and calls for the boat to return to the trailer by pressing the Return button 11 on the remote control 6. By monitoring a directional signal from the trailer and its radio transmitter 5, FIG. 1, the CPU moves the boat along the directional signal to the trailer. When the boat gets close to the trailer, the owner may take over control of the boat by using the bow thruster control buttons 8, the stern thruster control buttons 9 and the fore/aft control buttons 10. Using his remote control of the instant invention, the boat owner may safely and conveniently unload and load his boat on to his trailer without help from other people. This is particularly useful for fisherman who choose to fish alone or boat owners who work alone to take their boats out of the water for periodic maintenance.

The invention claimed is:

1. The instant invention is comprised of:

a. a single CPU for overall system management;

b. one or more multi-axis joysticks for onboard control input;

c. a multi-axis foot pedal control for hands-free control input while onboard the vessel;

d. a GPS transponder to collect position data from orbiting GPS satellites;

e. a transponder to transmit a direction radio frequency beam from the trailer/tow vehicle combination to the vessel;

f. a hand-held module for remote control of the vessel when the vessel and owner/operator are separated by considerable distance.

2. Using the onboard control input mechanisms (a), (b) and (c) of claim 1, which consist of the main CPU, the joystick and the foot pedal, the vessel operator may control the hull's thruster system for multi-axis control of the vessel; This motion consists of:

a. The ability to move the bow in a left/right direction, with respect to the fore/aft centerline of the vessel;

b. The ability to move the stern of the vessel in a left/right direction, with respect to the fore/aft centerline of the vessel;

c. The ability to use the bow and stern thrusters in a coordinated manner to rotate the vessel in either direction, clockwise or counter clockwise, around the vertical centerline of the vessel;

d. The ability to use the fore/aft thruster to move the vessel in a forward and rearward direction, with respect to the fore/aft, long-axis of the vessel;

e. The ability to move the vessel to any compass heading, leading with any surface of the vessel, which includes the bow, stern, port side, starboard side or any of the four corners of the vessel.

3. Using the remote control components (a) (d), (e) and (f) of claim 1, the owner may exercise control over the vessel when the vessel is in a location that is remote from the owner of the vessel;

The instant invention provides:

a. The ability for the owner to park the vessel at a location in the water that is distant and remote from the operator;

b. The ability to record the compass heading from the parked location to the home location on shore;

c. The ability to hold the vessel at the parked location using position data from orbiting GPS satellites;

d. The ability to maintain directional orientation from the vessel to the home location on shore during vessel movement that is caused by water and wind currents;

e. The ability to return to the shore location of the operator by returning, on a compass heading to the home location that was recorded when the vessel was initially parked at its remote location.

* * * * *